United States Patent [19]

Hara et al.

[11] Patent Number: 4,475,285

[45] Date of Patent: Oct. 9, 1984

[54] ELECTRIC SHAVER HAVING IMPROVED HAIR DISPOSAL SYSTEM

[75] Inventors: Hikoyoshi Hara; Hirozo Imai; Youji Iguchi, all of Osaka, Japan

[73] Assignee: Matsushita Electric Works, Ltd., Kadomi, Japan

[21] Appl. No.: 319,990

[22] Filed: Nov. 10, 1981

[30] Foreign Application Priority Data

Nov. 29, 1980 [JP] Japan ..... 55-168704

[51] Int. Cl.[3] ..... B26B 19/44

[52] U.S. Cl. ..... 30/41.6; 30/43.6

[58] Field of Search ..... 30/41, 41.3, 41.6, 43.6

[56] References Cited

U.S. PATENT DOCUMENTS 3,396,462 8/1968 Dufreshe ..... 30/41.5

FOREIGN PATENT DOCUMENTS 54-38862 3/1979 Japan ..... 30/41.6

*Primary Examiner*—E. R. Kazenske
*Assistant Examiner*—Douglas D. Watts
*Attorney, Agent, or Firm*—Poms, Smith, Lande & Rose

[57] ABSTRACT

An electric shaver has a housing which contains a motor. An inner blade support is mounted for rotation on the motor at one end of the housing, and an outer blade on the housing covers the inner blade support. Inner blades on the inner blade support revolve and are urged by springs against the outer blade, whereby hair extending through holes in the outer blade is cut by the inner blade. Openings through the inner blade support permit cut hair to drop therethrough, and the hair collects in a receptacle below the openings. Air flow caused by revolving the inner blade and other members on the inner blade support blows through the openings then near the receptacle to move hair from between the inner blade and the outer blade to the receptacle. The air flow then continues out of the housing through exhaust openings in the periphery of the outer blade. The air flowing from the openings is divided into two subcurrents flowing in two paths, a first path through the lower region of the area below the inner blade support and the second path through the upper region of the area below the inner blade support to decrease the volume and velocity of the air flow passing near the receptacle for preventing the air flow from moving hair from the receptacle out of the exhaust openings. A chamber is formed on the top surface of the inner blade support about each opening to trap cut hair there so that most hair will be directed through the openings. Arcuate slots near the edge of the inner blade support direct undesired centrifugal air flow downward and allow hair on the top of the support to fall to the receptacle. A rib that forms the forward wall of each chamber and each inner blade extend at angles to radii on the inner blade support intersecting the rib and the blade respectively to decrease air flow outward along the inner blade support.

23 Claims, 9 Drawing Figures

ELECTRIC SHAVER HAVING IMPROVED HAIR DISPOSAL SYSTEM

BACKGROUND OF THE INVENTION

The present invention relates to electric razors or shavers, primarily rotating ones, which are designed to prevent hair shavings from flying outside of the shaver and from building up on the internal parts.

In conventional shavers, an inner blade is urged against an outer blade or screen. The outer blade has hair guiding apertures through it, into which hair can extend. An inner blade is urged against the inside surface of the outer blade and moves relative to the outer blade to shear hair along the edges of the apertures of the outer blade.

Although the following discussion relates primarily to rotary electric shavers such as the shaver shown in U.S. Pat. No. 3,828,430 (1974) in which the inner blades rotate against and with respect to the outer blade, at least some aspects of the present invention have applicability to other types of electric shaver movements.

One problem in rotary electric shavers occurs with the severed hair. In certain prior art devices, the shavings tend to fly out of the hair guiding holes and to create an unclean and messy condition around the user. Filters are used to trap hair when the air flow is exhausted, but these filters need cleaning. See for example U.S. Pat. Nos. 3,571,926 (1971) and 2,376,197 (1945). Another problem occurs in the shaver because the severed hair collects on the supporting member for the inner blade. This hair eventually clogs the shaver, and hair adjacent the inner blade interferes with the contact between the inner and outer blades leading to a more rapid deterioration of the cutting edge of the inner blade. Thus, hair must be removed from between the inner blade supporting member and the outer blade, but the removal must be controlled so that severed hair will not be expelled from the shaver.

Previous shavers had extremely complex designs to alleviate the hair removal problem. For example, the previously mentioned U.S. Pat. No. 3,828,430 has numerous complex parts requiring intricate fabrication and assembly. Moreover, when cleaning inside the shaver is necessary, extra parts may easily be lost or damaged.

If air generated by blade rotation blows and directs the shavings off the inner blade support to a receptacle, problems still arise. If the flow of air is too powerful or is in the wrong direction, shavings may not be collected, and some that are collected below the inner blade support in a receptacle may be blown around the housing of the shaver back up to the area above the inner blade or out through the apertures in the outer blade screen. Hair being directed off the inner blade support may adhere to portions of the inner blade support unless air flow and centrifugal force properly removes hair from these portions.

If much hair is directed outward and a large centrifugal air flow is created, the hair will have a tendency to fly outward and to be ejected through the outer blade. If air is directed downward through the inner blade support and out between the outer edge of the inner blade support and the inside of the outer blade support then through openings in the periphery of the outer blade, hair that is carried by any centrifugal air flow beyond the outer edge of the inner blade support will be blown by the air flow emerging from below the inner blade support through the outer blade.

With this background in mind, the following are objects of the present invention:

To disclose and provide a rotary electric shaver that prevents hair shavings from flying outside of the shaver or from adhering to the shaver's inner blade support;

To disclose and provide an electric shaver in which the shavings are collected in a receptacle below the inner blade support;

To disclose and provide an electric shaver that efficiently directs air through openings in the inner blade support to direct hair toward the receptacle, but which limis the velocity of air flowing over the shaving accumulated in the receptacle to prevent such shavings from being driven by the flow of air out of the receptacle;

To disclose and provide a configuration for the parts of the apparatus that cooperate to help prevent the shavings from moving out of the receptacle under the influence of the flow of air;

To disclose and provide a construction that limits centrifugal air flow above the inner blade support below the outer blade;

To disclose and provide a device of relatively simple construction and assembly that can be taken apart easily for cleaning and reassembly without the risk of losing or damaging parts; and To disclose and provide a method of delivering shavings to a receptacle and retaining them therein.

The present invention meets the foregoing objects and other objects that may become evident in this specification.

Summary of the Invention

The improved shaver of the present invention has three major parts—(1) a housing with a motor inside, (2) an outer blade which is attached to an outer blade support to form a single unit that is attached to the housing, and (3) an inner blade support that has inner blades mounted to supporting structure thereon and that also form a unitary structure. The inner blade support unit is mounted under the outer blade unit to form a cutting unit with the inner blades positioned against the outer blade. The inner blade unit is supported and rotated by the motor. Rotation of the inner blade support revolves the inner blades along the inside surface of the outer blade to shear hair extending through holes in the outer blade.

A chamber extends upward from the inner blade support around each inner blade trapping cut hair in the chambers and creating high pressure in the chambers. Each inner blade extends through an opening in the base of each chamber, and the openings extend through the inner blade support directing the high pressure air and hair in the chamber through the openings to below the inner blade support. Structure below each opening may contribute to a suction through the opening.

Hair directed through the openings is deposited in a receptacle and the flow of air is exhausted from beneath the inner blade support and out of the shaver through openings in the periphery of the outer blade. Additional structure helps to maintain the hair in the receptacle. If all of the volume air that was generated through the openings passed near the receptacle at high velocity, it would blow hair being deposited in the receptacle around the inside of the shaver and out through the outer blade. Therefore, the air flow is divided into two subcurrents flowing in two paths exhausted through two exits to increase the exit area through which air flowing under the inner blade support can exhaust. One path is in the lower region of the area below the inner blade support near the receptacle, and the other path is in the upper region of the area below the inner blade support. By dividing the air flow into two paths, the volume and velocity of air flowing near the receptacle is decreased so that the hair will not be scattered. The inner blade is mounted at an angle on the inner blade support and ribs that form the chamber are constructed to limit centrifugal air flow above the inner blade support. Additional structure is provided for preventing any hair in the limited, centrifugal air flow from being carried beyond the periphery of the inner blade support where the hair would be carried by the upward main air flow from below the inner blade support to carry hair out through the outer blade.

DETAILED DESCRIPTION OF THE PREFERRED EMBODIMENT

The electric shaver of the present invention has three main parts: a housing 1, an outer blade 6 at one end of the housing and an inner blade support 8 mounted at the end of the housing 1 beneath the outer blade 6. The outer blade 6 and the inner blade support 8 together form a cutting unit that can be removed and connected to the housing.

Figure 1:
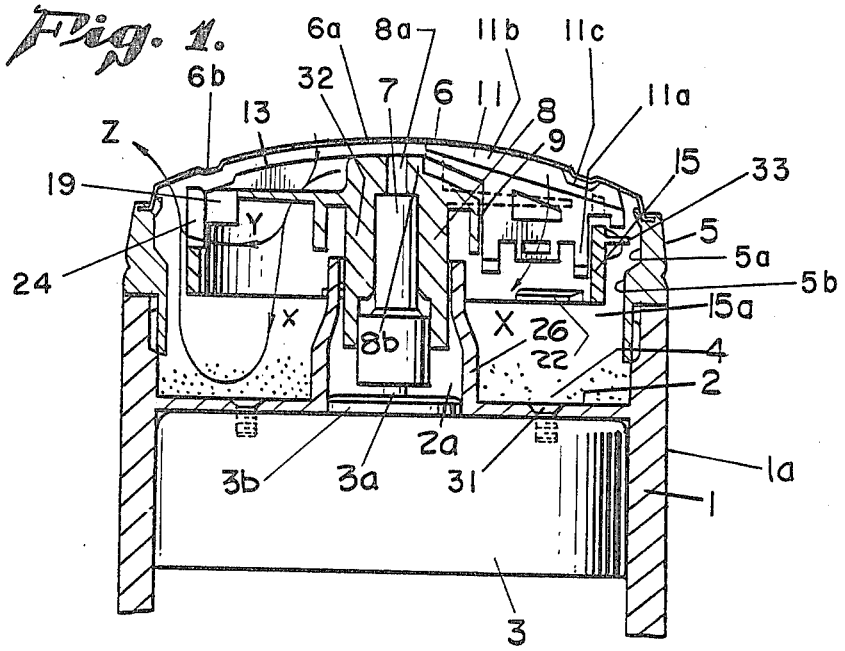
FIG. 1: A sectional view of one exemplary embodiment of the electric shaver of the present invention through plane I—I in FIG. 2.

The lower part of the housing 1 (FIG. 1) contains a motor 3 and a battery (not shown) which powers the motor. The motor 3 may also be energized by house current. The top of the housing 1 in FIG. 1 is generally H-shaped in section with annular partition wall 2 extending horizontally inward from circumferential wall 1*a* of the housing.

The inner blade support 8 is mounted above the motor 3 and the partition 2 to be rotated by the motor. Screws 31 extending through partition wall 2 secure the motor 3 to the partition wall. Partition 2 has a preferably circular central opening 2*a* (FIG. 1) which receives a boss 3*b* of the motor 3. A circumferential hub 26 extends upward from partition wall 2 around central opening 2*a*. Coupler 7 is attached to output shaft 3*a* of the motor 3, and the coupler extends upward through hub 26. The coupler 7 supports the inner blade support 8 in that the coupler is inserted into downwardly extending sleeve 32 of inner blade support 8. The bottom of sleeve 32 extends into hub 26 (FIG. 1), and the inside surface of hub 26 is close to the outside surface of sleeve 32 to prevent most hair from falling inside the hub 26. A small hole 8*a* extends through the upper surface 8*b* of support 8 to aid in insertion or removal of coupler 7 from sleeve 32 by eliminating pressure or vacuum within the sleeve. When the coupler 7 is rotated by the motor 3, axial notches 32*a* (FIG. 4) on sleeve 32 cooperated with the corresponding indentations on coupler 7 for positive rotation of the sleeve 32 and the entire inner blade support 8.

The outer blade 6 (FIG. 1) has a dome-like shape and is formed of preferably thin, corrosion-resistant metal. Outer blade 6 has many hair-receiving openings therethrough with sharpened edges on the bottom surface. When inner blades 11, which are mounted on the inner blade support 8 in a manner described below, revolve in contact with the bottom surface of the outer blade, they shear hair in a scissors-like action against the edges of the outer blade 6. The outer blade 6 also has a tubular base portion 5 to which the dome-like portion is attached, and the base 5 and the outer blade 6 form a unitary member which is screwed to the upper edge of wall 1*a* at the top of the housing 1 (FIG. 1). The outer blade 6 and its base 5 can be removed from the housing for access to the inner blade support 8, which also can be removed from coupler 7 for access to the area above the partition 2. As set forth below, the entire cutting unit, which consists of the outer blade 6 and its base 5 and the inner blade support 8, normally is removed from the housing 1 as a unit.

Figure 2:
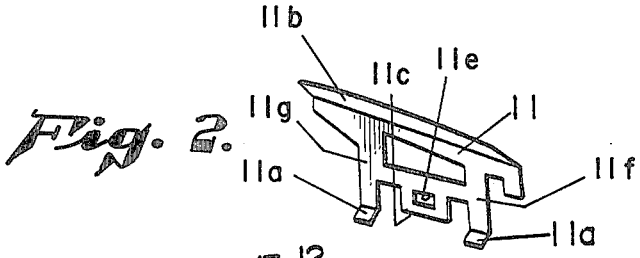
FIG. 2: An exploded perspective view of the inner blade support of the present invention along with an inner blade and a spring for supporting it.
Figure 2:
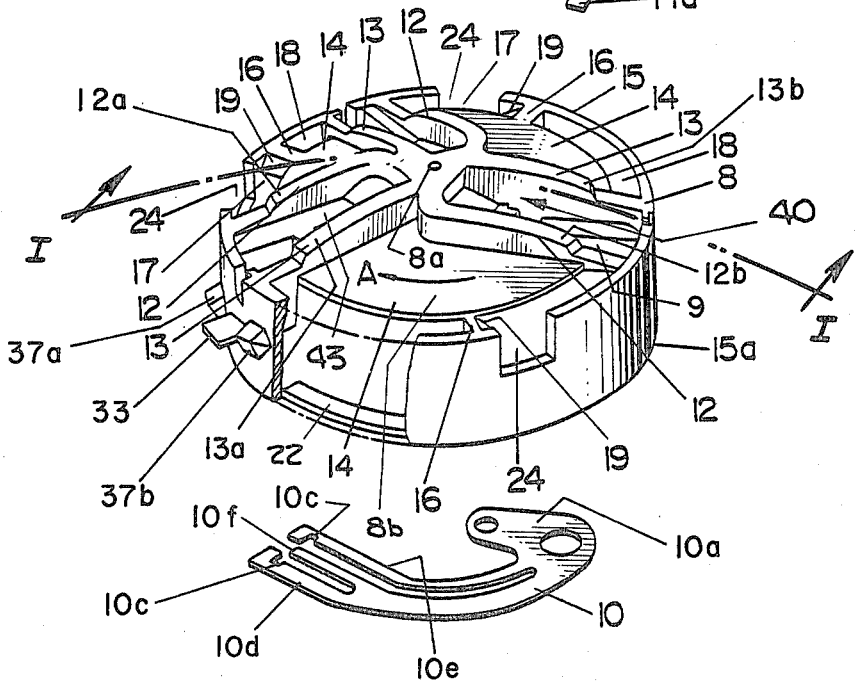
Figure 3:
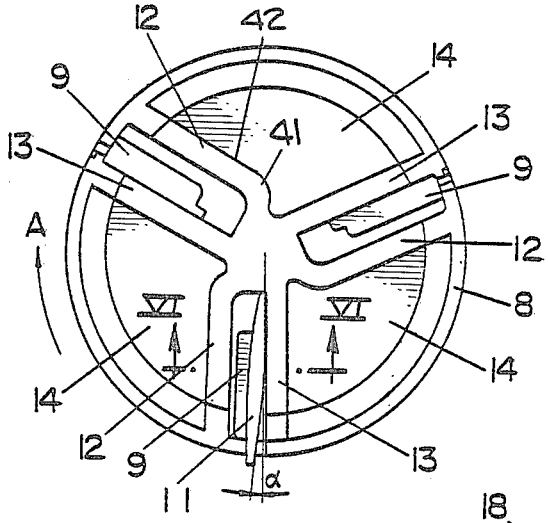
FIG. 3: A top view of the inner blade support of the present invention.

As shown in FIG. 2, the inner blade support 8 is preferably formed of molded plastic. All of the projections and openings, the functions of which will be discussed below, are formed during the molding process. Metal inner blades 11 and support springs 10 (FIG. 2), which are attached to the inner blade support 8 in a manner set forth below, are assembled to the inner blade support 8 to create a single unit that can be removed from its location under outer blade 6 and off the motor 3 above the partition 2.

The inner blade support 8 has a plurality of circumferentially spaced, relatively thin, flexible flanges 33 and thicker, rigid flanges 37*a* and 37*b* (FIGS. 1, 2 and 4) extending outward from the circumferential wall 15. The flanges are adapted to be received in the circumferential and continuous, radially outwardly relieved groove 5*a* around the inner surface of the base 5 (FIG. 1). Groove 5*a* is axially inward of the opening at the bottom of the base 5. The flexible flanges 33, which entend outward slightly farther than flanges 37*a* and 37*b*, are adapted to be bent slightly to permit the inner blade support 8 to be inserted into and removed from the narrower diameter portion 5*b*, of the opening of the base 5. This facilitates the preassembly of the inner blade support 8 to the outer blade 5 with the flexible flanges 33 retained in the base 5. Rigid flanges 37*a* and 37*b*, which protect flanges 33, are short enough to pass narrow portion 5*b*. When the tubular base 5 is removed from the housing 1, the flexible flanges 33 will tend to retain the inner blade support 8 in the base 5 because the force exerted on inner blade support 8 by coupler 7 during removal of the outer blade 6 and its frame 5 is insufficient to bend flexible flanges 33 enough to permit the flanges 33 to pass narrow diameter portion 5*b*. Thus, the flanges 33, 37*a* and 37*b* will be retained in the groove 5*a*, and the inner blade support will normally remain in the outer blade 6 and base 5 unit to keep the two parts together as a cutting unit. If desired, the inner blade support 8 can be removed from base 5 by pulling the inner blade support sufficiently hard to bend flexible flanges 33 enough to allow the flanges to pass narrow diameter portion 5*b*.

As shown in FIG. 1, the sharpened top surface of each of the inner blades 11 conforms to the bottom surface of dome-shaped outer blade 6, and spring plates 10 (FIG. 2) urge and constantly maintain the inner blades 11 against the bottom surface of outer blade 6 in a manner described below during revolution of the inner blades 11. The outer blade 6 has a continuous circumferential indentation 6*b* (FIG. 1) that projects downwardly to be received in a notch 11*c* in each of the inner blades 11 to align the revolution and to reduce lateral movement of the inner blades 11 with respect to the outer blade 6. Thus, during the shaving operation, the inner blade support 8 rotates at high speed to revolve each of the inner blades 11, and the sharp upper surface of each inner blade 11 moves along the inner surface of outer blade 6 to shear hair extending through the apertures 6*a* at the edges of the outer blade 6.

Figure 4:
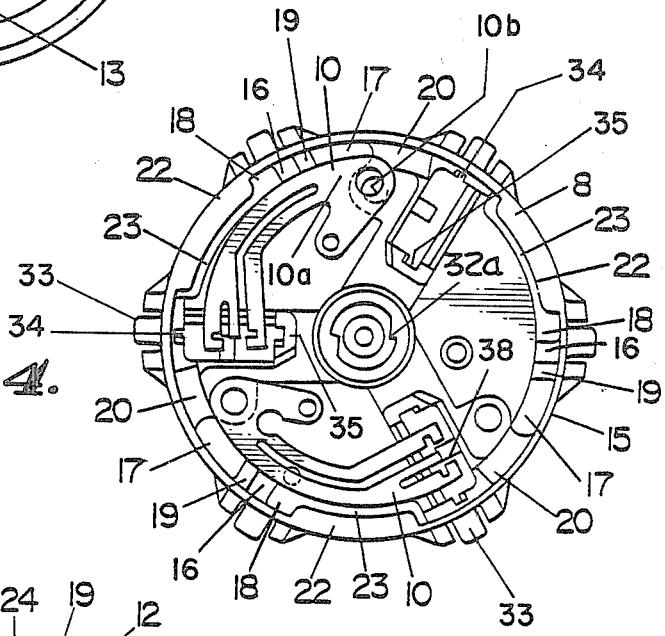
FIG. 4: A bottom view of the inner blade support.
Figure 5:
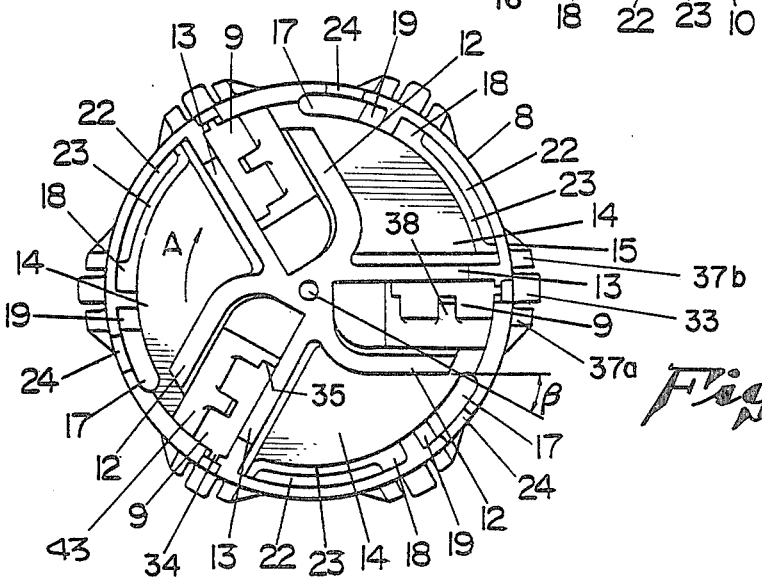
FIG. 5: Another top view of the present invention showing primarily the inner blade support.
Figure 6:
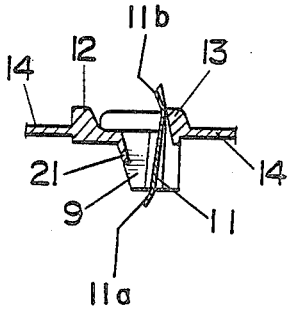
FIG. 6: A sectional view taken through plane VI—VI of FIG. 3 and showing the mounting of the blade in the inner blade support.

In the first exemplary embodiment, an inner blade 11 extends through each of the openings or drop-through holes 9 (FIGS. 2–6), which extend through the inner blade support means 8. The three drop-through holes 9 are spaced every 120 degrees apart. Each blade is supported at its bottom by arcuately shaped upward pressure spring plate 10 (FIGS. 2 and 4), and each spring 10 urges its inner blade 11 against the bottom surface of outer blade 6. Each spring plate 10 is received in a space along the bottom surface of the inner blade support 8 (FIG. 4), and base 10*a* of each spring is heat sealed or plastic welded to the bottom surface at 10*b* (FIG. 4). The bottom of each inner blade 11 (FIG. 2) has a projection 11*c* that fits between opposing notches 10*c* in arms 10*b* and 10*e* of the spring plate 10, and arm 10*f* fits into hole 11*e* on the inner blade to secure the bottom of inner blade 11 in the opening 9. The top cutting portion 11*b* of each inner blade 11 extends upward out of its opening 9 against the outer blade 6. Each inner blade 11 has side arms 11*f* and 11*g* (FIG. 2) which fit between guides 34 and 35 and tab 38 (FIG. 4) to permit guided vertical movement of inner blades 11 in openings 9. Tabs 11*a* (FIGS. 1 and 2) at the bottom of each inner blade are gripping surfaces which are held while inner blade 11 is inserted through openings 9 from below (FIG. 6).

Because the springs 10 are permanently attached to the inner blade support 8, and because each spring 10 securely holds an inner blade 11 which normally will not be removed except during possible replacement or sharpening, the inner blade support 8 is assembled with the springs 10 and inner blades 11 to create a single unit (FIG. 2).

The openings 9 through which inner blades 11 extend provide the additional function of being openings or dropthrough holes 9 that extend through the inner blade support 8. Cut hair on the top of inner blade support 8 is directed through openings 9 to be deposited in a receptacle 4 (FIG. 1) below the inner blade support 8 as set forth more fully below.

The receptacle 4 is annular. Partition 2 forms the bottom wall (FIG. 1), circumferential housing wall 1*a* forms the outer wall, and hub 26 forms the inner wall. Receptacle 4 is deep enough to receive and store a desired amount of shavings.

The inner blade support 8 includes a generally round upper or top section 8*b* (FIG. 2) with a circumferential wall 25 therearound. Rib means extending upward on the top 8*a* of inner blade support 8 generally surround each opening 9 to create a chamber-like structure 40 that at least partially surrounds each opening 9 to trap cut hair so that the hair falls through each opening 9. The rib means also create a region of high pressure above each opening when the inner blade support 8 rotates. High pressure generates an air flow through each opening 9 to direct hair down through each opening. In the exemplary embodiment, the rib means comprise first and second ribs 12 and 13 that extend upward from the upper surface of the inner blade support 8 close to the bottom surface of outer blade 6. Each first rib 12 (FIGS. 2, 3 and 5) is on the leading side in the direction of rotation of inner blade support 8 of a corresponding opening 9 and has a short part 41 (FIG. 3) extending generally radially outward from the center of the support section, which forms the back wall of the chamber 40. Rib 12 also includes a section 42 that is angled to part 41, which forms a sidewall of the chamber 40 and is generally parallel to the second rib 13. The second rib 13 extends generally radially outward from the center of the support section 8*b* on the other side of the corresponding opening 9 and forms the other sidewall of chamber 40. As shown in FIG. 2, the circumferential wall 15 has a portion that extends upward slightly above the top surfaces 43 between adjacents ribs 12 and 13 (FIGS. 2 and 5) to form an outside wall of each chamber 40.

First rib 12 makes an angle $\beta$ (FIG. 5) with a line extending from the radius. Both the first and second ribs 12 and 13 are tapered (FIG. 2), being shorter nearer the circumference of the top 8*a* of inner blade support 8. During shaving when the inner blade 11 is against the outer blade 6, the tops of ribs 12 and 13 will be near the outer blade but out of contact and the taper of the ribs permits the tops to conform more closely to the dome shape of the outer blade. Each inner blade 11 is mounted at a slight angle $\alpha$ to a radius intersecting the blade 11 (FIG. 3), and the angle decreases centrifugal flow from each chamber 40 during rotation of the inner blade support 8 to hold the hairs within the chambers where they can be directed through the openings 9.

When the inner blade support 8 rotates, high pressure is generated in front of each inner blade 11 and its associated second rib 13 in each chamber 40. This high pressure causes an air flow through each opening 9, the main opening in each chamber. The flow is enhanced because a short vane 21 (FIG. 6) extends downward from the bottom of the inner blade support 8 adjacent and forward (in the direction of rotation of inner blade support 8) of each opening 9 to create a downward air flow in front of and immediately below each opening 9, which causes a reduced pressure, suction effect drawing air through each opening 9.

Because most of the hair will be cut in front of each inner blade 11 in its chamber 40, the high pressure above each opening 9 combines with the downward flow immediately below the opening to direct hair from the chamber 40 through opening 9 toward the receptacle below the inner blade support.

A relatively large volume of air emerges from the openigs 9 at a relatively high velocity. Inertia tends to direct the hair toward the receptacle. A flow of too much volume at too much velocity, however, tends to overcome the inertia of the hairs causing them to scatter below the inner blade support 8 and/or to be carried out of the receptacle. As air emerges from the openings 9, the air looses velocity because the area below upper section 8*b* of the inner blade support 8 is greater than the area of the openings 9. Therefore, the space below the upper section 8*b* of the inner blade support 8 is sometimes referred to as the velocity reducing zone. As the flow of air is again restricted to pass through the smaller area between the inner blade support 8 and the base 5 of the outer blade 6, the flow increases in velocity. If the exhaust path is only under the circumferential wall 15, that air accelerates near the receptacle 4 to scatter hair and direct it upward where it can be carried out of the holes along the periphery of the outer blade 6.

Therefore, in the present invention, dividing means are provided for directing air current flowing from the opening means 9 along two subcurrents following two paths through the velocity reducing zone under the inner blade support 8. The first path (path X in FIG. 1 of the exemplary embodiment) is through the lower portion of the velocity reducing zone, and the second path (path Y in FIG. 1) is through the upper portion of the velocity reducing zone. Paths X and Y are generalized, and the air currents are not necessarily confined to narrow paths.

The dividing means comprises two exit means through the inner blade support 8 for exhausting air from below the inner blade support 8. The first exit means in the first exemplary embodiment comprises an exhaust space between the receptacle 4 and the bottom 15*a* of circumferential wall 15 extending down from the top of inner blade support 8. The air current that follows path X passes near the receptacle 4, and then the air is exhausted through the exhaust space between the bottom 15*a* of circumferential wall 15 and the receptacle 4. In the first exemplary embodiment, the second exit means comprises three bypass notches or exhaust openings 24 (FIG. 2) above the first exhaust exit means. Exhaust openings 24 extend through circumferential wall 15 from the top downward to slightly less than half the height of circumferential wall 15. The second exit means create a greater exhaust area for air flowing from openings 9*a*. Therefore, the air current that follows path X from openings 9 is at a lower velocity and has less volume because some of the air for the openings 9 follows path Y.

Once the hair shavings are through openings 9, their inertia causes them to fall into receptacle 4. If all of the air passing through an opening 9 flowed in path X (FIG. 1), the velocity and volume of that air flow would be too great and would re-scatter the hair shavings causing them to flow upward, out of the receptacle. Likewise, if all of the air followed path Y, the velocity and volume of that air flow would overcome the inertia of the hair and would direct hair out through the second exit means. Because of the present invention, inertia carries hair to the receptacle 4 and the velocity and volume of air is insufficient to overcome the inertia, and such hair is not rescattered from the receptacle.

The air current following path Y, being above the air current along path X, tend to form a boundary layer above the receptacle 4 to hold shavings in the receptacle.

The air currents that follow paths X and Y emerge from their respective exit means and merge outside of the inner blade support 8 where the flows follow path Z through openings in the periphery of the outer blade 6.

For convenience, ribs 12 and 13 associated with the same opening 9 are referred to as "adjacent ribs," such as ribs 12*a* and 13*a*. The two ribs 12 and 13 that are next closest to each other but are associated with adjacent openings 9 are called "opposing ribs," such as ribs 12*b*, 13*a*. Generally flat, fan-shaped upper surface areas 14 are formed between opposing first and second ribs 12 and 13 (e.g. opposing ribs 13*a* and 12*b*). When the inner blade support means 8 rotates, high pressure ahead of each of the ribs 12 generates an air current. Much of this air current normally would be forced through the opening in upper blade 6, and shavings which escape from chambers 40 and which are on or above surface areas 14 would be thrown out of the shaver. To limit the centrifugally forced air flow that causes cut hair to blow around the interior of the shaver and through the apertures in the outer blade 6, in the present invention first rib 12 is formed at an angle $\beta$ (FIG. 5) to a radius intersecting the outer end of rib 12. The angle changes the direction of the air flow ahead of rib 12 and limits centrifugal air flow, which decreases the likelihood of having shavings blown through the outer blade 6.

As best seen in FIG. 2, arcuate shaped slots 17 and 18 are formed at the edge end of the top portion 8*b* of the inner blade support 8 between the top 8*b* and the circumferential wall or skirt 15. A reinforcing rib 16 separates adjacent arcuate slots 17 and 18. A tapered surface 19 (FIG. 2) extends from the trailing edge of each reinforcing rib 16, and another tapered surface 20 (FIG. 4) is formed at the trailing edge of each slot 17 extending inward from the inside of circumferential wall 15. Tapered surfaces 19 and 20 create low pressure in slots 17 and 18, and draw air on surface areas 14 down through the slots 17 and 18. The limited centrifugally forced air flow, which would carry some shavings, flows down through slots 17 and 18 and is prevented from passing beyond circumferential wall 15. The top of the wall 15 also extends above the plane of surface area 14 (FIG. 2). Thus, air on the top surface areas 14 of inner blade support 8 does not carry hair past wall 15 where the air would merge with the upward, main flow following path Z from the receptacle 4 and notch 24 (paths X and Y) past the outside of circumferential wall 15 and outer blade support 5. If hair is carried into this main flow, it would be blown out of the outer blade 6. Rather, the shavings are directed down through slots 17 and 18 into the receptacle 4. The arcuate slots 17 and 18 contribute to directing hair shavings in the receptacle 4 because those that might fall on upper surface areas 14 are urged by centrifugal force outward where they fall through slots 17 and 18. The air flow that passes through the slots 17 and 18 also helps to remove hair shavings that might attach to the inside of circumferential wall 15.

The design of the inner blade support further facilitates keeping the shavings in the receptacle 4. An arcuate shield 22 (FIGS. 1 and 4) extends inwardly from the bottom 15*a* of circumferential wall 15 a distance less than the slot width (FIG. 4) leaving only a narrow gap 23 between the inner edge of the shield 22 and the arcuate slot 18. This restricts hair shavings from rising upward out of the receptacle 4.

Figure 7:
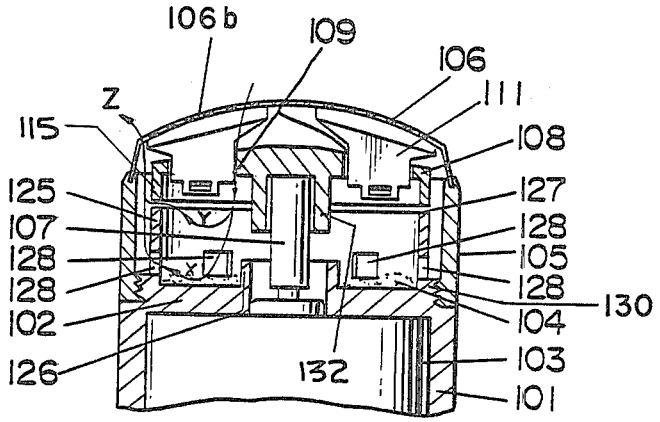
FIG. 7: A side cross-sectional view of a second embodiment of the present invention.

In a second exemplary embodiment illustrated in FIG. 7, many element similar to elements in the first embodiment have reference numbers increased by 100; in the third embodiment, the reference numbers are increased by 200. Thus, in FIG. 1, the housing is element 1, in FIG. 7, the housing is element 101, and in FIG. 8, the housing is element 201. In FIG. 7 housing 101 and outer blade 106 are very similar to the corresponding elements FIG. 1. Housing 101 has a partition wall 102 below which motor 103 is mounted. An annular receptacle 104 is formed on the other side of the partition 102 between inner circumferential hub 126 and outer circumferential flange 130. As in the first embodiment, the outer blade 106 also includes a tubular base 105 to which the dome-like portion of the outer blade 6 is attached to form a unitary element which is screwed to the top of housing 101. The outer blade 106 has many hair-guiding holes 106*b* through it.

Inner blade support 108 is mounted in the housing 101 below the outer blade 106. A coupler 107, which is attached to the output shaft of motor 103, extends upward through hub 126 into sleeve 132 of inner blade support 108, to position and rotate inner blade support means 108. The inner blade support 108 can be removed from coupler 107 for cleaning below the inner blade support in a manner similar to that explained in the first embodiment.

Inner blade support 108 has opening means in the form of hair shaving drop-through holes 109 similar to opening 9 in the first embodiment, and an inner blade 111 extends through each of the openings 109 where it is held by suitable supporting structure not shown but similar to that in the first embodiment.

As in the first embodiment, air flows down through openings 109 because inner blade support 108 rotates and creates high pressure above openings 109. The air flows generally along path X (FIG. 7) toward the receptacle 104 where hair is deposited. The circumferential wall or skirt 115 of the inner blade support 108 has a lower circumferential wall 125 aligned with circumferential wall 115 and extending almost to the top of flange 130. Lower wall 125 may be attached to the bottom of circumferential wall 115 in many ways. For example, it could be attached by means of ribs (not shown) between wall 115 and lower wall 125, and because wall 115 and lower wall 125 are spaced apart, slots 127 are formed. Slots 127 are second exit means having the same function in this embodiment as do exhaust openings or notches 24 in the first embodiment. They act as exhaust openings through circumferential wall 115 and its lower wall 125, and they direct a portion of the air flow that is generated through opening 109 along path Y through slots 127.

The lower wall 125 could also be attached directly to sleeve 132 by means of radial ribs (not shown) extending between sleeve 132 and lower wall 125. Such an arrangement permits the slots 127 to extend continuously between circumferential wall 115 and lower wall 125. Axial ribs will effect air flow below the inner blade support, however, for which compensation must be made.

To assist in holding shavings in receptacle 104, lower wall 125 extends downward close to the top of flange 130 that defines the outside wall of receptacle 104. There are several exhaust holes 128 through the outer lower wall 125 near the bottom. The exhaust holes 128 in this embodiment are the first exit means that serve the same function that the extended space between the bottom 15*a* of circumferential wall 15 and the receptacle 4 serves in the first embodiment. That is, the portion of the air flow through opening 109 that follows path X to the receptacle 104 is exhausted from within the lower wall through exhaust openings 128.

During shaving, hair severed by movement of the inner blades 111 along the interior of outer blade 106 is carried down through openings 109 that extend through the inner blade support 108 by air flow generated through the openings 109 by the rotation of the inner blade support 108. The air current from openings 109 takes two paths. Some follows the lower path, path X, through first exit exhaust holes 128, and some air follows the upper path, path Y, through the second exit of slots 127. Air current following paths X and Y merge beyond their respective exits outside of the inner blade support 108 and the merged current escapes as flow Z through the holes around the periphery of the outer blade 106. Because the air current following path X that escapes through exhaust openings 128 via the receptacle 104 is weakened because some air follows path Y, hair shavings in the receptacle tend less to fly about or to be lifted out of the shaver once they have reached the receptacle.

Figure 8:
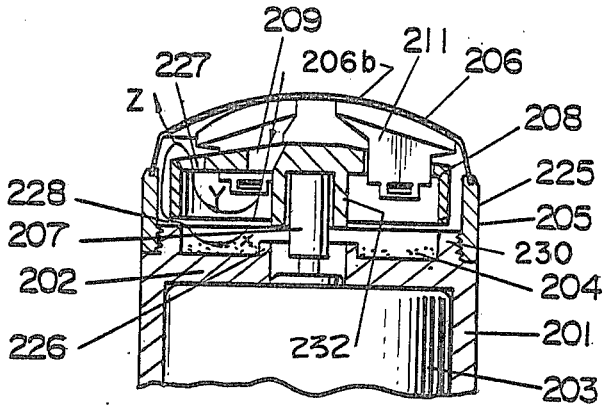
FIG. 8: A sectional view of a third embodiment of the present invention.
Figure 9:
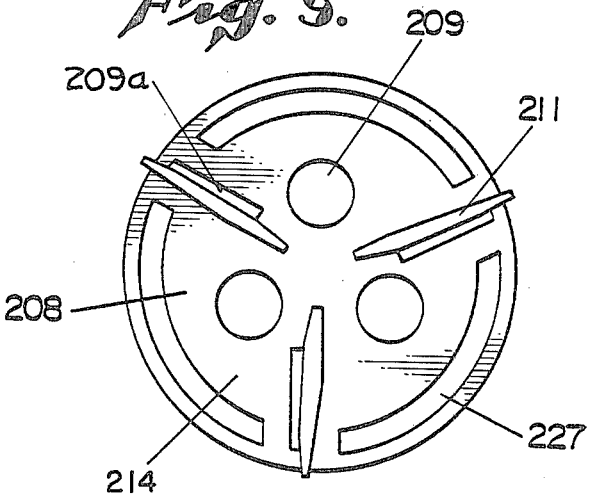
FIG. 9: A top view looking down on the inner blade support of the third embodiment.

A third embodiment is shown in FIGS. 8 and 9. There are still essentially three basic parts—housing 201, inner blade support 208 near the top of the housing, and a combined outer blade 206 and its base 205 over the inner blade support 208.

Housing 201 has a compartment partition wall 202. Motor 203 mounted below the partition rotates a coupler 207 that extends through hub 226 that extends upward about an opening through the center of the partition 202. The coupler 207 engages the inner blade support means 208 by being inserted into sleeve 232 integrally molded and extending down from the top of inner blade support 208. The motor thus drives the inner blade support 208.

A receptacle 204 for holding the hair shavings is formed on the upper side of the compartment partition wall 202 in the space between outer circumferential flange 230 and interior hub 226 (FIG. 8). The tubular base 205 is conventionally screwed onto the upper edge of housing 201 to the outside of flange 230. The outer blade 206, which has many hair-guiding holes 206*b* through it, is attached to the upper edge of base 205. As in previous embodiments, the inner blade support 208 has inner blades 211 mounted through openings 209*a* (FIG. 9), and support 208 and inner blades 211 are constructed in such a manner similar to the construction of, the first embodiment (FIGS. 1–6) such that each inner blade 211 exerts pressure against the interior surface of outer blade 206. The springs and the associated structure for mounting the inner blades are not shown in the drawings, however.

Upwardly extending annular flange 230 is generally axially aligned with the circumferential wall 225 of the inner blade support 208. Because the circumferential wall 225 is spaced slightly above flange 230, an exhaust expulsion gap 228 (FIG. 8) is created. Gap 228 serves the same function as the space between the receptacle 4 and the bottom 15*a* of the circumferential wall 15 in the first embodiment. That is, gap 228 is the first exit for exhausting air in the lower region of the velocity reducing zone below the inner blade support 208.

The inner blade support 208 is modified from the previously discussed embodiment (1) by having hair shavings drop-through holes 209 that are spaced apart from the inner blades 211. The inner blades 211 may be fixed to the inner blade support 208 or they may extend through additional openings 209*a* through the inner blade support 208; and (2) by having the second exit be arcuately shaped bypass slots 227 extending through the outer circumferential area of the top of the inner blades support 208 (FIG. 9) rather than through the circumferential wall (15 or 115) in previous embodiments.

As the inner blades 211 and the other structure on inner blade support 208 revolve during rotation of inner blade support 208, they create high pressure above the upper surface of inner blade support 208. The pressure difference creates an air flow that carries hair, which is cut by the inner blades 211 moving against outer blade 206, through openings 209 and 209*a*. Additional protrusions may be used, especially below the upper surface of inner blade support to increase the air flow.

As in the previous embodiments, the air current from each of the openings 209 and 209*a* may travel two paths. In the first, lower path (path X in FIG. 8), the air flows through exhaust gap 228 (FIG. 8) and upward between outer blade frame 205 and circumferential wall 225. The air of the first path is then exhausted through holes in the periphery of outer blade 206. Some air flow emerging from openings 209 and 209*a* follows a second, upper path (path Y in FIG. 8) upward through arcuate slots 227 where that air merges with air flowing along path X and is exhausted through holes in the periphery of the outer blade 206 along path Z.

Therefore, a shaver meeting the stated objects has been shown.

We claim:

1. In a cutting unit adapted to be attached to an electric shaver, the cutting unit comprising an outer blade having a plurality of hair-receiving apertures therethrough; inner blade support means including inner blade means positioned against the inside surface of the outer blade for shearing hair at the edges of the hair-receiving apertures during movement of the inner blade means along the inside of the outer blade means, the inner blade support means being beneath the outer blade for positioning the inner blade means against the outer blade and for moving the inner blade means along the inside of the outer blade under movement by a motor in the shaver; and opening means comprising at least one opening extending through the inner blade support means for passing an air current generated by the inner blade support means during its movement and for passing cut hair from between the inner blade support means and the outer blade to a velocity reducing zone below the opening means, the improvement comprising:

rib means extending upright and at least partially about each opening for forming a chamber-like structure about each opening to hold cut hair therein and to create a region of high pressure air above the opening during rotation of the inner blade support means whereby the high pressure air blows through each opening and carries hair from above the opening means to below the inner blade support means.

2. The cutting unit of claim 1 further comprising vane means extending downwardly from the inner blade support means adjacent the opening means for creating downward air flow below the opening means during rotation of the inner blade support means for enhancing air flow through the opening means.

3. The cutting unit of claim 1 wherein each inner blade is mounted at an angle to an intersecting radius from the center of the inner blade support means such that the outer end of each blade is forward of the radius in the direction of rotation of the inner blade support means to lower air flow outward along the inner blade support means during rotation thereof.

4. The cutting unit of claim 1 further comprising generally arcuate slots along the periphery of the top of the inner blade support means for directing therethrough hair that is above the inner blade support means and outside of the chamber-like structure.

5. The cutting unit of claim 4 wherein the inner blade support means has a generally round, top section and a circumferential wall extending downward therefrom, the cutting unit further comprising shield means extending inwardly slightly less than the width of the arcuate slots from the circumferential wall and below the arcuate slots to block hair being carried by air flow from below the inner blade support means.

6. The cutting unit of claim 4 further comprising means extending from the inner blade support means into the arcuate slots for generating air flow from above the inner blade support means through the arcuate slots for blowing hair that is above the inner blade support means through the arcuate slots.

7. The cutting unit of claim 4 wherein the inner blade support means comprises a top section and a circumferential wall extending generally downward therefrom, the circumferential wall extending above the top surface of the inner blade support means for blocking the flow of air above the inner blade support means beyond the periphery thereof.

8. The cutting unit of claim 1 wherein the opening means comprises at least one opening, the rib means comprising a first rib and a second rib extending upward from the upper surface of the inner blade support means, the second rib extending generally radially outwardly from the center of the upper surface adjacent to and after each of the openings through the inner blade support means in the direction of rotation of the inner blade support means to form one sidewall of the chamber-like structure, each first rib being on the other side of the opening from the second rib, each first rib having one portion extending radially outward from the center of the inner blade support means for forming the inside wall of the chamber-like structure, and a second portion at an angle to the first portion and generally parallel to the second rib on the other side of the corresponding opening for forming the other sidewall of the chamber-like structure and for limiting the air flow directed radially outward along the top surface of the inner blade support means.

9. The cutting unit of claim 8 wherein the first and second ribs taper downwardly from the center of the inner blade support section.

10. The cutting unit of claim 9 wherein the inner blade support means further comprises a circumferential wall extending generally downwardly from the periphery of the inner blade support means, a portion of the circumferential wall extending upward at the outside of the chamber-like structure to form an outside wall thereof.

11. In a cutting unit adapted to be attached to an electric shaver including a housing, the cutting unit comprising an outer blade having a plurality of hair-receiving apertures therethrough; inner blade support means including inner blade means positioned against the inside surface of the outer blade for shearing hair at the edges of the hair-receiving apertures during movement of the inner blade means along the inside of the outer blade means, the inner blade support means being beneath the outer blade for positioning the inner blade means against the outer blade and for moving the inner blade means along the inside of the outer blade under movement by a motor in the shaver; and opening means extending through the inner blade support means for passing an air current generated by the inner blade support means during its movement and for passing cut hair between the inner blade support means and the outer blade to an air velocity reducing zone below the opening means, the improvement comprising:

air current dividing means for dividing the air current from the opening means into two subcurrents flowing two paths, a first path extending through the lower region of the air velocity reducing zone and a second path extending through the upper region of the air velocity reducing zone;

said inner blade support means comprising a top section and a circumferential wall depending from the periphery of the top section to near the top of the housing, wherein an upper region of the air velocity reducing zone is below the top section of the inner blade support and within the circumferential wall;

said air current dividing means comprising a first exhaust means under the bottom of the circumferential wall for exhausting air from the opening means along the first path under the inner blade support means.

12. In a cutting unit adapted to be attached to an electric shaver including a housing, the cutting unit comprising an outer blade having a plurality of hair-receiving apertures therethrough; inner blade support means including inner blade means positioned against the inside surface of the outer blade for shearing hair at the edges of the hair-receiving apertures during movement of the inner blade means along the inside of the outer blade means, the inner blade support means being beneath the outer blade for positioning the inner blade means against the outer blade and for moving the inner blade means along the inside of the outer blade under movement by a motor in the shaver; an opening means extending through the inner blade support means for passing an air current generated by the inner blade support means during its movement and for passing cut hair from between the inner blade support means and the outer blade to an air velocity reducing zone below the opening means, the improvement comprising:

air current dividing means for dividing the air current from the opening means into two subcurrents flowing in two paths, a first path extending through the lower region of the air velocity reducing zone and a second path extending through the upper region of the air velocity reducing zone;

said outer blade having a tubular base seated on the housing, the inner blade support means further comprising a plurality of flexible flanges extending outwardly from the inner blade support, the inside surface of the tubular base having a circumferential and continuous, radially outward, relieved groove axially inward of the bottom opening of the tubular base, the flexible flanges projecting outwardly a distance from the axis of the inner blade support means that is less than the inside radius of the tubular base at the groove and greater than the inside radius of the tubular base below the groove, the flexible flanges facilitating the pre-assembly of the inner blade support means to the tubular base with the flexible flanges retaining the inner blade support in the tubular base with the flexible flanges in the groove, the flexible flanges being adapted to be bent for permitting the flexible flanges to pass through the tubular base of the outer blade below the groove during assembly and disassembly of the inner blade support means and the outer blade.

13. The cutting unit of claim 12 further comprising;

a pair of rigid flanges adjacent to and on each side of each flexible flange and extending outwardly from the inner blade support means a distance less than the distance the flexible flange extends to protect the flexible flanges.

14. In a cutting unit adapted to be attached to an electric shaver including a housing, the cutting unit comprising an outer blade having a plurality of hair-receiving apertures therethrough; inner blade support means including inner blade means positioned against the inside surface of the outer blade for shearing hair at the edges of the hair receiving apertures during movement of the inner blade means along the inside of the outer blade means, the inner blade support means being beneath the outer blade for positioning the inner blade means against the outer blade and for moving the inner blade means along the inside of the outer blade under movement by a motor in the shaver; an opening means extending through the inner blade support means for passing an air current generated by the inner blade support means during its movement and for passing cut hair from between the inner blade support means in the outer blade to an air velocity reducing zone below the opening means, the improvement comprising:

air current dividing means for dividing the air current from the opening means into two subcurrents flowing in two paths, a first path extending through the lower region of the air velocity reducing zone and a second path extending through the upper region of the air velocity reducing zone;

said inner blade support means comprising a generally round top section and a downwardly extending circumferential wall about the periphery of the inner blade support means, the air current dividing means comprising first exhaust means comprising a gap between the bottom of the circumferential wall and a portion of the housing on which the cutting unit is mounted, and the second exhaust means comprising at least one exhaust aperture through the circumferential wall above the bottom thereof.

15. The cutting unit of claim 14 further comprising arcuate slots about the periphery of the inner blade support means extending through the top of the inner blade support means at the periphery thereof inside of the circumferential wall, the exhaust aperture of the second exhaust means extending through the circumferential wall at the arcuate slots.

16. The cutting unit of claim 14 wherein the opening means through the top section of the inner blade support means is spaced apart from the inner blade means.

17. In a cutting unit adapted to be attached to an electric shaver, the cutting unit comprising an outer blade having a plurality of hair-receiving apertures therethrough; inner blade support means including inner blade means positioned against the inside surface of the outer blade for shearing hair at the edges of the hair-receiving apertures during movement of the inner blade means along the inside of the outer blade means, the inner blade support means being beneath the outer blade for positioning the inner blade means against the outer blade and for moving the inner blade means along the inside of the outer blade under movement by a motor in the shaver; an opening means extending through the inner blade support means for passing an air current generated by the inner blade support means during its movement and for passing cut hair from between the inner blade support means in the outer blade to an air velocity reducing zone below the opening means, the improvement comprising:

air current dividing means for dividing the air current from the opening means into two subcurrents flowing two paths, a first path extending through the lower region of the air velocity reducing zone and a second path extending through the upper region of the air velocity reducing zone;

and rib means extending upward from the inner blade support means at least partially surrounding the opening means for forming a chamber-like region about the opening means for creating a region of high pressure above the opening means to cause air to flow downward through the opening means during movement of the inner blade support means.

18. The cutting unit of claim 17 wherein the inner blade means comprises a plurality of inner blades, the opening means comprising a plurality of openings, each inner blade extending through a corresponding opening of the opening means.

19. The cutting unit of claim 18 further comprising spring means in the form of arcuately shaped spring plates attached to the bottom of the inner blade support means and to each of the inner blades securing each inner blade to the inner blade support means and for urging the inner blades through the opening means against the outer blade.

20. In a cutting unit adapted to be attached to an electric shaver, the cutting unit comprising an outer blade having a plurality of hair-receiving apertures therethrough; inner blade support means including inner blade means positioned against the inside surface of the outer blade for shearing hair at the edges of the hair-receiving apertures during movement of the inner blade means along the inside of the outer blade means, the inner blade support means being beneath the outer blade for positioning the inner blade means against the outer blade and for moving the inner blade means along the inside of the outer blade under movement by a motor in the shaver; and opening means extending through the inner blade support means for passing an air current generated by the inner blade support means during its movement and for passing cut hair from between the inner blade support means and the outer blade to an air velocity reducing zone below the opening means, the improvement comprising:

air current dividing means for dividing the air current from the opening means in two subcurrents flowing in two paths, a first path extending through the lower region of the air velocity reducing zone and a second path extending through the upper region of the air velocity reducing zone;

said inner blade means comprising at least one inner blade, each inner blade being mounted at an angle to an intersecting radius from the center of the inner blade support means such that the outer end of each blade is forward of the radius in the direction of rotation of the inner blade support means to lower air flow outward along the inner blade support means during rotation thereof.

21. In a cutting unit adapted to be attached to an electric shaver, the cutting unit comprising an outer blade having a plurality of hair-receiving apertures therethrough; inner blade support means including inner blade means positioned against the inside surface of the outer blade for shearing hair at the edges of the hair receiving apertures during movement of the inner blade means along the inside of the outer blade means, the inner blade support means being beneath the outer blade for positioning the inner blade means against the outer blade and moving the inner blade means along the inside of the outer blade under movement by a motor in the shaver; an opening means extending through the inner blade support means for passing an air current generated by the inner support means during its movement and for passing cut hair from between the inner blade support means and the outer blade to an air velocity reducing zone below the opening means, the improvement comprising:

air current dividing means for dividing the air current into two subcurrents flowing in two paths, a first path extending through the lower region of the air velocity reducing zone, and a second path extending through the upper region of the air velocity reducing zone;

means forming generally arcuate slots along the outer circumference of the top of the inner blade support means and spaced from the opening means for directing therethrough hair that is above the inner blade support means and spaced from the opening means;

the inner blade support means having a generally round, top section and a circumferential wall extending downward from the periphery of the top section, the cutting unit further comprising shield means extending inwardly from the circumferential wall a distance less than the width of the arcuate slots and below the arcuate slots to block hair being carried by air flow from below the inner blade support means.

22. In a cutting unit adapted to be attached to an electric shaver, the cutting unit comprising an outer blade having a plurality of hair-receiving apertures therethrough; inner blade support means including inner blade means positioned against the inside surface of the outer blade for shearing hair at the edges of the hair-receiving apertures during movement of the inner blade means along the inside of the outer blade means, the inner blade support means being beneath the outer blade for positioning the inner blade means against the outer blade and moving the inner blade means along the inside of the outer blade under movement by a motor in the shaver; an opening means extending through the inner blade support means for passing an air current generated by the inner support means during its movement and for passing cut air from between the inner blade support means and the outer blade to an air velocity reducing zone below the opening means, the improvement comprising;

air current dividing means for dividing the air current into two subcurrents flowing in two paths, a first path extending through the lower region of the air velocity reducing zone, and a second path extending through the upper region of the air velocity reducing zone;

means forming generally arcuate slots along the outer circumference of the top of the inner blade support means and spaced from the opening means for directing therethrough hair that is above the inner blade support means and spaced from the opening means;

means extending from the inner blade support means into the arcuate slots for generating air flow from above the inner blade support means through the arcuate slots for blowing hair which is above the inner blade support means through the arcuate slots.

23. The cutting unit of claim 21 wherein the circumferential wall extends above the top surface of the inner blade support means for blocking the flow of air above the inner blade support means beyond the periphery thereof.

* * * * *